US005712081A

United States Patent [19]

Andriessen et al.

[11] Patent Number: 5,712,081

[45] Date of Patent: Jan. 27, 1998

[54] METHOD FOR REPRODUCING AN ELECTRONICALLY STORED MEDICAL IMAGE ON A HARDCOPY MATERIAL

[75] Inventors: Hieronymus Andriessen, Beerse; Freddy Henderickx, Olen, both of Belgium

[73] Assignee: AGFA-Gevaert, N.V., Mortsel, Belgium

[21] Appl. No.: 812,265

[22] Filed: Mar. 6, 1997

[30] Foreign Application Priority Data

Mar. 7, 1996 [NL] Netherlands ..... 962006227

[51] Int. Cl.[6] ..... G03C 5/29

[52] U.S. Cl. ..... 430/440; 430/399; 430/446; 430/480; 430/486; 430/622

[58] Field of Search ..... 430/399, 440, 430/446, 480, 486, 622

[56] References Cited

U.S. PATENT DOCUMENTS

| | | | |
|---|---|---|---|
| 5,116,722 | 5/1992 | Callant et al. | 430/363 |
| 5,250,409 | 10/1993 | Yasunani et al. | 430/527 |
| 5,593,817 | 1/1997 | Henderickx et al. | 430/440 |
| 5,604,082 | 2/1997 | Henderickx et al. | 430/440 |
| 5,620,836 | 4/1997 | Heremans et al. | 430/496 |

*Primary Examiner*—Hoa Van Le
*Attorney, Agent, or Firm*—Breiner & Breiner

[57] ABSTRACT

A method of reproducing an electronically stored medical image on a hardcopy material is disclosed, said material comprising a support and on only one side thereof a silver halide emulsion layer and a hydrophilic colloid layer, wherein said emulsion layer comprises red sensitized homogeneous cubic silver chloride, silver chloroiodide, silver chlorobromide or silver chlorobromoiodide crystals having not less than 70 mole % of chloride ions and preferably not less than 90 mole %; not more than 1 mole % of iodide ions and an average crystal size of from 0.12 to 0.30 μm and more preferred from 0.15 to 0.25 μm; wherein said crystals are coated in an amount, expressed as an equivalent amount of silver nitrate of from 2 to 6 g per sq.m., and wherein said material has a hardening degree corresponding with a water absorption of up to 3 g per gram of gelatin at an emulsion side, the said water absorption being measured by the method disclosed herein;

said method of image formation being characterized by the steps of image-wise exposure of said material with an electronically adressed red or infrared laser followed by development processing in a developer free from hardening agents in less than 20 seconds in a total processing time from 30 to 50 seconds from dry to dry, wherein said developer contains a compound corresponding to formula (I) given herein, a precursor thereof, a derivative thereof and/or a metal salt thereof, being more preferably (iso)ascorbic acid;

replenishing said developer in an amount of not more than 100 ml per square meter of developed material;

fixing said developer in a time from 2 to 10 seconds;

rinsing and drying.

14 Claims, No Drawings

METHOD FOR REPRODUCING AN ELECTRONICALLY STORED MEDICAL IMAGE ON A HARDCOPY MATERIAL

DESCRIPTION

1. Field of the Invention

This invention relates to a method of reproducing an electronically stored medical image on a hardcopy material.

2. Background of the Invention

There is a trend in medical diagnosis to provide hardcopies of images, produced by electronic diagnostic techniques such as computer tomography, magnetic resonance imaging, ultrasound etc., by means of a digital laser imager, replacing rapidly the older technology of CRT printers. As opposed to analog CRT camera's, a laser imager is a digital system containing a high performance digital computer offering more advantages. Instead of just printing the images, the incoming images can be stored temporarily in an electronic memory and the data as well as the lay-out of the images can be manipulated before actually being printed on a film. This electronic memory offers the possibility to buffer the incoming data from several diagnostic modalities by means of an image network, which is a real advantage in comparison with e.g. CRT imaging wherein the hard copy is exposed image by image. In that case, while one examination is taking place, the imager is unavailable for others and as a result, each diagnostic unit requires a separate CRT imager.

The photographic hardcopy material, used in the laser imagers, combines an excellent image quality with the appropriate physical properties, necessary for an error free filmhandling by the imager. With regard to image quality, the photographic material preferably has high sharpness, a good image tone (color hue) of the developed silver, preferably a purely black image, a preferred gloss level, and appropriate contrast values no allow a high maximum density and crisp alfanumerics.

Another trend in medical imaging is the demand for rapid access of the photographic images. Especially when implemented in an image network, the access time of the laser hardcopy material should be as short as possible. Factors responsible for delayed rates at which the process proceeds may be the exposure time of the film by the laser, the transport time before exposure to the system and after exposure to an automatic processor, and the processing time, dry-to-dry, of the hardcopy material. Whereas the exposure time and transport time are dependent on specific features of the laser source, the mechanical construction of the system and the dimensions of the hardcopy material, the processing time is especially determined by the film characteristics (sensitivity, also called "speed") and the chemicals used in the processing cycle. Typical modern processors have dry-to-dry cycles of less than 60 seconds, more preferable less than or equal to 50 seconds.

Last but not least, there is a stringent demand for processing medical images in developing and fixing baths free from hardeners. Hardener free chemistry offers higher convenience with respect to ecology, manipulation and regeneration of chemicals in the automatic processor provided that the hardcopy material has the expected sensitometric results as e.g. sensitivity, gradation and maximum density within restricted processing time limits. The hardening agent reduces the drying time in the automatic processor by cross-linking the gelatin chains of the photographic material, thereby reducing the water adsorption of said material. Therefore, a photographic material suited for hardener free processing should be forehardened during emulsion coating in order to allow a short dry-to-dry processing cycle.

From e.g. U.S. Pat. Nos. 3,241,640 and 5,112,731 it can be learned that flat tabular grains are preferred for a photographic material intended for hardener free processing of direct exposure X-ray images and for hardcopy images, generated by means of CRT printers. Indeed, it is well known that flat tabular grains combine a high speed with a large covering power (density vs. developed silver), even at high hardening degrees. This is in favour of coating amounts of silver halide crystals which can be reduced to a remarkable extent, further providing an ecological advantage in that lower amounts of chemicals are required and less regeneration amounts.

For laser imaging however, lower speeds are required and flat tabular grains are not preferred due to the low contrast values and the brownish image tone of tabular grain emulsions. Another way to get a high covering power is to make use of silver halide emulsions with crystals having a smaller average crystal size. Especially cubic silver bromoiodide crystals are well-known to provide enough speed, as has been described in EP-A 0 610 608. However, reducing the average crystal size of said bromoiodide crystals to less than 0.30 μm makes image tone become more brownish after development and thus unsuitabe for use.

3. Objects of the Invention

Therefore it is an object of the present invention to provide a method of reproducing an electronically stored medical image on a hardcopy material suitable for laser recording, intended for hardener free processing with minimum amounts of chemicals in favour of ecology within a dry-to-dry cycle time of from 30 to less than 50 seconds, offering a suitable speed and image tone.

4. Summary of the Invention

In accordance with the present invention, a method of reproducing an electronically stored medical image on a hardcopy material is disclosed, said material comprising a support and on only one side thereof a silver halide emulsion layer and a hydrophilic colloid layer, wherein said emulsion layer comprises red sensitized homogeneous cubic silver chloride, silver chloroiodide, silver chlorobromide or silver chlorobromoiodide crystals having not less than 70 mole % of chloride ions and preferably not less than 90 mole %; not more than 1 mole % of iodide ions and an average crystal size of from 0.12 to 0.30 μm and more preferred from 0.15 to 0.25 μm; wherein said crystals are coated in an amount, expressed as an equivalent amount of silver nitrate of from 2 to 6 g per sq.m., and wherein said material has a hardening degree corresponding with a water absorption of up to 3 g per gram of gelatin at an emulsion side, the said water absorption being measured by following steps:

preserving dry film material for 15 minutes in a conditioning room at 20° C. and 30% RH, covering backing topcoat layer of the said dry film material with a water impermeable tape, weighing the said dry film material, immersing unexposed material in demineralized water of 24° C. for 10 minutes, sucking up excessive amount of water present on top of outermost layers and immediately determining weight of the wet film and calculating measured weight differences between wet and dry film and calculating the said differences per square meter of film and dividing it by coated amount of gelatin per sq.m.;

said method being characterized by the steps of image-wise exposure of said material with an electronically adressed red or infrared laser followed by development processing in a developer free from hardening agents in less than 20 seconds in a total processing time from 30 to 50 seconds from dry to dry, wherein said developer contains a compound corresponding to formula (I), a precursor thereof, a derivative thereof and/or a metal salt thereof (I)

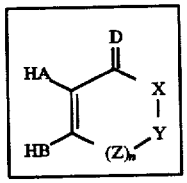

wherein each of A, B and D independently represents an oxygen atom or $NR^1$;

X represents an oxygen atom, a sulphur atom, $NR^2$; $CR^3R^4$; C=O; $C=NR^5$ or C=S;

Y represents an oxygen atom, a sulphur atom, $NR'^2$; $CR'^3R'^4$; C=O; $C=NR'^5$ or C=S;

Z represents an oxygen atom, a sulphur atom, $NR''^2$; $CR''^3R''^4$; C=O; $C=NR''^5$ or C=S;

n equals 0, 1 or 2;

each of $R^1$ to $R^5$, $R'^1$ to $R'^5$ and $R''^1$ to $R''^5$, independently represents hydrogen, alkyl, aralkyl, hydroxyalkyl, carboxyalkyl; alkenyl, alkynyl, cycloalkyl, cycloalkenyl, aryl or heterocyclyl;

and wherein $R^3$ and $R^4$, $R'^3$ and $R'^4$, $R''^3$ and $R''^4$, may further form together a ring; and wherein in the case that $X=CR^3R^4$ and $Y=CR'^3R'^4$, $R^3$ and $R'^3$ and/or $R^4$ and $R'^4$ may form a ring and wherein in the case that $Y=CR'^3R'^4$ and $Z=CR''^3R''^4$ with n=1 or 2, $R'^3$ and $R''^3$ and/or $R'^4$ and $R''^4$ may form a ring;

replenishing said developer in an amount of not more than 100 ml per square meter of developed material;

fixing said developer in a time from 2 to 10 seconds;

rinsing and drying.

Furthermore in accordance with the present invention a method showing high convenience is provided for the reproduction of a medical, electronically stored image on the silver halide light-sensitive hardcopy material disclosed hereinbefore comprising the steps of exposing said hardcopy material with a red or infrared laser source within a time of less than or equal to 10 s for a size format of 14"×17"; transporting said hardcopy material to an automatic processor within a time of less than or equal to 5 s; processing dry-to-dry said hardcopy material in said automatic processor proceeding within a time of from 30 to less than 50 s making use of developer and fixer solutions without hardening agent.

By this method it is capable to provide in a time interval of one minute at least 4 consecutive sheets with a size format of 17"×14" of the said silver halide light-sensitive hardcopy material of medical, electronically stored images.

5. Detailed Description

The hardcopy material used in the image formation method according to the present invention is particularly useful for the reproduction of electronically stored medical images by means of a laser recorder.

Said hardcopy material essentially is a photographic material comprising silver chloride, silver chloroiodide, silver chlorobromide and/or silver chlorobromoiodide emulsions coated on a support in at least one emulsion layer on one side of said support.

Quite unexpectedly it has become clear from our experiments that even when an emulsion layer of said material comprises relatively small cubic silver chloride, silver chloroiodide, silver chlorobromide and/or silver chlorobromoiodide crystals, further referred to as "cubic crystals rich in chloride", having a crystal size from 0.12 to 0.30 μm, and more preferably from 0.15 to 0.25 μm sufficient speed was attained without deterioration of image tone, in that a shift to brown colored silver after development was observed.

Preferably the said emulsions rich in silver chloride have crystals or grains having a monodisperse grain size distribution. Said size distribution is called "monodisperse" when 95% of the grains have a size that does not deviate more than 30% from the average grain size, and more preferably not more than 20%.

Cubic crystals are especially preferred as they allow rapid processing. In principle the same should be possible with flat tabular crystals but, even if methods are applied that reveal a more homogeneous silver halide distribution, it is difficult to get small tabular crystals offering a suitable sensitivity. Moreover due to the light-reflection of the developed silver from said tabular grains which is situated at longer wavelengths the image tone is not neutral but shifted to a unacceptable reddish brown color.

The emulsions containing cubic crystals rich in chloride coated in the emulsion layer(s) of the hardcopy material used in the image-forming method according to this invention may be prepared by mixing the halide (chloride being in excess versus bromide and/or iodide, if present) and silver salt solutions in partially or fully controlled conditions of temperature, concentrations, sequence of addition, and rates of addition. The silver halide is preferably precipitated according to the double-jet method, in the presence of a colloid binder in a temperature controlled vessel provided with a solution inlet and stirring unit.

A preferred precipitation technique is the double-jet method, wherein the silver ion concentration is controlled during the precipitation and wherein the flow rate of the reacting solutions is enhanced as the precipitation proceeds, at such a rate that no renucleation appears. This method offers the possiblity to get well-defined crystals having a regular cubic habit within a short precipitation time. Preferred cubic crystals rich in chloride have a crystal size between 0.12 and 0.30 μm, more preferably between 0.15 and 0.25 μm and even more preferably between 0.20 and 0.25 μm. A suitable black image tone of the silver generated after developing cubic crystals having up to at most 30 mole % and more preferred up to at most 10 mole % of silver bromide and/or up to at most 1 mole % of iodide is obtained as well as a high covering power of the developed grains.

Colloidal binders used during precipitation of the cubic crystals rich in silver chloride are hydrophilic binders such as the frequently used gelatin. Gelatin may, however, be replaced in part or integrally by synthetic, semi-synthetic, or natural polymers. Synthetic substitutes for gelatin are e.g. polyvinyl alcohol, poly-N-vinyl pyrrolidone, polyvinyl imidazole, polyvinyl pyrazole, polyacrylamide, polyacrylic acid, and derivatives thereof, in particular copolymers thereof. Natural substitutes for gelatin are e.g. other proteins such as zein, albumin and casein, cellulose, saccharides, starch, and alginates. In general, the semi-synthetic substitutes for gelatin are modified natural products e.g. gelatin derivatives obtained by conversion of gelatin with alkylating or acylating agents, by grafting of polymerizable monomers on gelatin or prehardened gelatins with blocked functional groups as a consequence of this prehardening treatment, and cellulose derivatives such as hydroxyalkyl cellulose, carboxymethyl cellulose, phthaloyl cellulose, and cellulose sulphates.

The binder should of course dispose of an acceptably high number of functional groups, which by reaction with an appropriate hardening agent can provide a sufficiently resistant layer. Such functional groups are especially the amino groups, but also carboxylic groups, hydroxy groups, and active methylene groups.

Another substitute for gelatin may be silica as has been described in the published EP-A's 0 392 092, 0 517 961, 0 528 476, 0 649 051 and 0 704 749.

If gelatin is used as a binder gelatin may be lime-treated or acid-treated. The preparation of such gelatin types has been described in e.g. "The Science and Technology of Gelatin", edited by A. G. Ward and A. Courts, Academic Press 1977, page 295 and next pages. The gelatin may also be an enzyme-treated gelatin as described in Bull. Soc. Sci. Phot. Japan, No 16, page 30 (1966). Preferably use is made of photographically inert gelatin in order to add a reproducible amount of chemical sensitizers at the end of the precipitation or after flocculation or washing or redispersing the emulsion rich in silver chloride. To get a qualitatively good flocculate flocculating agents as e.g. polystyrene sulphonic acid, etc., may be added before or after acidifying the emulsion. Other possibilities are offered by filtration techniques e.g. by dialysis, ultrafiltration etc. so that the emulsion may be washed to a desired pAg value without the requirement to be redispersed afterwards. Emulsion flocculates need to be washed out by the addition of well-determined amounts of demineralized water, whether or not doped with small amounts of water-soluble salts like e.g. sodium or potassium chloride.

The light-sensitive emulsion rich in silver chloride coated in light-sensitive hydrophilic layers of the hardcopy material used in the image-forming method according to the present invention is preferably chemically sensitized in order to reach its required sensitivity as described e.g. in "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in said literature chemical sensitization may be carried out by effecting the ripening in the presence of small amounts of compounds containing sulphur e.g. thiosulphate, thiocyanate, thioureas, sulphites, mercapto compounds, and rhodamines. The emulsions may be sensitized also by means of gold-sulphur ripeners or by means of reductors e.g. tin compounds as described in GB-A 789,823, amines, hydrazine derivatives, formamidine-sulphinic acids, and silane compounds.

It has been found that in the hardcopy materials containing emulsions rich in chloride suitable for use in the image-forming method according to the present invention chemical sensitization of said emulsions advantageously leads to an enhanced speed when use is made of selenium compounds as e.g. triphenylphosphorselenide. Said selenium compounds are replacing sulphur compounds or are used in combination therewith. Most preferred is a combination of sulphur, selenium and gold generated from suitable compounds.

It has further been established that addition of small amounts of iridium compounds during and/or at the end of the precipitation step and/or in the chemical ripening step is highly preferred and leads to a positive effect on processing latitude, in that less differences in sensitivity and gradation are observed after fluctuations in developing time within a range of 5 seconds and in processing temperature within a range of 10° C., if compared with iridium doped silver bromide and silver bromoiodide crystals.

Preferred amounts of a preferred compound as e.g. potassium hexachloroiridate (III), added during chemical ripening, are from 0.5 to 20 μmole per mole of silver and more preferred from 1 to 5 μmole per mole.

Other suitable dopants used during precipitation or chemical ripening of the silver chloride or silver chlorobromide emulsion crystals may be Fe, Co, Ni, Ru, Rh, Pd, Os, Pt, Pb, Cd, Hg, Tl and Au.

One of these chemical sensitization methods or a combination thereof may be used.

Preferably the silver halide crystals are predigested with weakly oxidizing compounds as e.g. thiosulphonic acids before being chemically ripened.

Chemical sensitization may occur in the presence of spectral sensitizers. The said spectral sensitizers have been chosen as a function of the gas or semiconductor laser source used, showing a high light absorption at the exposure wavelength of the said laser source.

Spectral sensitizers may be added partially before, partially after or integrally after chemical sensitization with a total amount needed to reach the optimal coverage degree.

The light-sensitive cubic silver halide emulsions rich in chloride used in the image-forming method according to the present invention may be spectrally sensitized with methine dyes such as those described by F. M. Hamer in "The Cyanine Dyes and Related Compounds", 1964, John Wiley & Sons. Dyes that may be used for the purpose of spectral sensitization include cyanine dyes, merocyanine dyes, complex cyanine dyes, complex merocyanine dyes, homopolar cyanine dyes, hemicyanine dyes, styryl dyes and hemioxonol dyes. Particularly preferred dyes are those absorbing in the red or infrared wavelength region of the wavelength spectrum, said dyes being selected from the group consisting of di-, tri-, tetra-, penta- and heptamethine cyanines and merocyanines, rhodacyanines and polynuclear merocyanines.

Especially suitable sensitizing dyes in the red part of the visible spectrum are trimethinecyanines as described e.g. in U.S. Pat. No. 3,282,933; in EP-A 0 467 370; in JP-A 05 040 324; in SU 01 645 270; in DE 01 028 718 and in GB 2,267,287. Structures having a meso —S—$CH_3$ substitution therein have been described in U.S. Pat. Nos. 2,557,806 and 3,460,947 and in GB's 1,207,006 and 2,048,888. Pentamethines absorbing more bathochromically are also very suitable and have been described in U.S. Pat. Nos. 3,615,632 and 3,669,672; in DE 03 216 568; in JP-A's 50 000 503; 53 142 223; 62 191 846; 62 194 252; 62 254 139; 62 262 853; 63 100 448 and 63 264 743 and in JP-B's 85 057 583; 92 064 060; 93 058 176; 93 060 093; 93 220 339 and 94 058 536. Dyes absorbing in the infrared region, are described e.g. in JP-A 02 071 257 and in Research Disclosure 00 289 052, May 1988, p. 301–303.

Other especially useful red absorbing spectral sensitizers are heptamethines and rhodacyanines. In accordance with this invention rhodacyanine dyes with chemical structures as described e.g. in EP-A 0 473 209 are the most preferred (see sensitizing dye (1) in the Examples hereinafter) as well as heptamethine sensitizing dye (2), also described in the Examples hereinafter.

Dimethine merocyanines useful as red light absorbing spectral sensitizers have been described in U.S. Pat. Nos.

3,625,698 and 4,461,828; in EP-Specification 0 127 455; in JP-A 61 281 235; in JP-B 76 041 055 and in DE's 01 028 718 and 02 330 602. Tetramethine merocyanines, also absorbing red light, have been described in U.S. Pat. Nos. 2,493,747; 2,497,876; 2,719,152; 2,947,631; 3,288,610; 3,385,707; 3,439,774; 3,519,430; 3,537,858; 3,567,458; 3,576,641; 3,579,348; 3,615,640; 3,642,786; 3,660,102; 3,854,956; 2,719,152; 2,742,833; 3,519,430; 3,642,787; 3,658,522 and 4,113,496; in GB's 846,298; 1,078,227; 1,144,548 and 1,192,267; SU 01 126 572; 1,192,267; 1,582,132; 2,065,314 and 2,162,855; in DE's 02 207 352 and 02 451 158; in JP-A's 51 059 881; 51 123 223; 62 073 251; 62 208 043; 59 135 461; 60 131 533; 60 170 852; 60 192 937; 60 263 937; 61 174 540; 61 262 739; 61 282 832; 62 087 953; 62 089 038; 62 174 740; 62 254 147; 62 275 239; 63 104 234; 02 124 561; 02 262 653; 02 269 334 and 03 110 545; and in JP-B's 76 041 055; 80 015 013; 83 004 335; 65 014 112; 65 023 67; 67 023 573; 67 027 165; 67 027 166; 67 027 167; 70 015 894; 74 046 416; 76 041 055; 77 025 333; 79 036 852; 84 017 822; 91 007 930 and 93 003 570; in EP-Specification 0 412 851 and in Research Disclosure 160058 and in J. Imag. Sci. Technol. Vol. 57 (6), p. 589–597 (1993).

Polynuclear merocyanines absorbing very bathochromically in the red wavelength region with a structure having a benzthiazine nucleus have been described in U.S. Pat. No. 4,228,232; in DE's 02 140 539 and 02 917 483; in GB 2,020,297 and in JP-B 80 002 613, whereas specific structures with a benzoxazol nucleus have been described in U.S. Pat. Nos. 2,493,748 and 3,110,591; in ES 00 374 301; in JP-A's 61 077 843 and 02 519 001 and in JP-B's 76 041 055; 79 034 331 and 91 007 091. Other specific structures of polynuclear spectral sensitizers have been described in WO's 95/007822 and 95/007950; in JP-A 05 119 425 and in JP-B 89 038 299; in BE 00 508 677; in CH 00 677 409; in DE 00 958 684; in FR 01 103 384; in GB 789,077; in EP-A's 0 467 370 and 0 614 114; in EP-B 0 427 892; in JP-A 05 313 285 and in JP-B 86 045 548.

Other dyes, which do not have any spectral sensitization activity, or certain other compounds, which do not substantially absorb visible radiation, may have a supersensitization effect when they are incorporated together with said spectral sensitizing agents into the emulsion. Suitable supersensitizers are e.g. heterocyclic mercapto compounds containing at least one electronegative substituent as described e.g. in U.S. Pat. No. 3,457,078, nitrogen-containing heterocyclic ring-substituted aminostilbene compounds as described e.g. in U.S. Pat. Nos. 2,933,390 and 3,635,721; aromatic organic acid/formaldehyde condensation products as described e.g. in U.S. Pat. No. 3,743,510, cadmium salts, and azaindene compounds.

The silver halide emulsion(s) coated in hardcopy materials used in the image-forming method according to the present invention may comprise compounds preventing the formation of fog or stabilizing the photographic characteristics during the production or storage of photographic elements or during the photographic treatment thereof. Many known compounds may be added as fog-inhibiting agent or stabilizer to the silver halide emulsion. Suitable examples are i.a. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothia-diazoles, aminotriazoles, benzotriazoles (preferably 5-methyl-benzo-triazole), nitrobenzotriazoles, mercaptotetrazoles, in particular 1-phenyl-5-mercaptotetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines, such as those described in GB-A 1,203,757, GB-A 1,209,146, JP-A 75-39537 and GB-A 1,500,278, and 7-hydroxy-s-triazolo-[1,5-a]-pyrimidines as described in U.S. Pat. No. 4,727,017, and other compounds such as benzenethiosulphonic acid, benzenethiosulphinic acid, benzenethiosulphonic acid amide. Other compounds that may be used as fog-inhibiting compounds are metal salts such as e.g. the compounds described in Research Disclosure No 17643 (1978), Chaptre VI.

Preferred stabilizers added to the silver chloride, silver chloroiodide, silver chlorobromide or silver chlorobromoiodide emulsion coated in the emulsion layer(s) of the hardcopy material used in the method according to the present invention are e.g. 4-hydroxy-6-methyl-1,3,3a,7-tetraazaindene, 1-phenyl-5-mercaptotetrazole etc., thioether substituted 1-phenyl-5-mercaptotetrazoles as described in EP-A 0 053 851 being more preferable, especially if they have a solubilizable group as those described e.g. in Research Disclosure No. 24236 (1984).

Fog-inhibiting agents or stabilizers can be added to the silver halide emulsion prior to, during, or after the ripening thereof and mixtures of two or more of these compounds may be used.

A mixture of two or more emulsions from cubic crystals rich in chloride having the same or different crystal sizes, a different or the same chemical ripening treatment and/or a different or the same coverage degree with one or more spectral sensitizers being different from each other or the same, as those described hereinbefore may be added to at least one light-sensitive emulsion layer.

If more than one emulsion layer is coated onto one side of the support the same or different emulsions or emulsion mixtures may be present in the different layers. If the same emulsion or emulsion mixture is present in different emulsion layers it is a preferred embodiment to add distinct amounts of spectral sensitizer during chemical ripening and/or preparation for coating in order to get a broader exposure latitude for the material according to the image-forming method of the present invention and less sensitometric fluctuations in the processing of the hardcopy material.

For the hardcopy material used in the image-forming method according to the present invention a total amount of coated silver halide crystals rich in chloride, expressed as an equivalent amount of silver nitrate, is preferably from 2 to 6 $g/m^2$, and more preferably from 3 to 5 $g/m^2$.

In order to enable the unexposed silver halide crystals rich in chloride to be fixed entirely in the fixation step of the rapid processing cycle it is further preferred to have a the total gelatin content at the emulsion side of from 1 to 3 $g/m^2$.

Especially the presence of the preferred homogeneous cubic crystals rich in chloride described hereinbefore enables the customer to reach the desired sensitometry (high gradation and high maximum density) within short processing times with such a low coating amount of silver, ensuring the preferred black image tone.

Other useful ingredients added to the emulsion layer(s), to an antihalation undercoat layer and/or to an antistress layer and/or to one or more backing layers are antihalation dyes, developing accelerators, plasticizers, hardeners, matting agents, thickening agents, surface active agents, polymers, antistatic agents, lubricants etc.

Antihalation dyes are chosen as a function of the applied red or infrared gas or semi-conductor laser source. Preferred antihalation dyes applied in the hardcopy material used in the image-forming method according to the present invention are red light or infrared absorbing dyes. At least one antihalation dye is preferably added to at least one emulsion layer in amounts necessary to reduce light scattering phenomena leading to a better sharpness. Preferably antihalation dyes are added in variable amounts during coating in order to adjust the sensitivity of the hardcopy material. So it may be advantageous to introduce at least one antihalation dye by means of a dosing feeder just before coating to adjust the sensitivity of the photographic material as required by the product specifications. The said antihalation dye or dyes may be present in the form of solutions thereof, in the form of a gelatinous dispersion or in a solid particle state.

In the hardcopy material used in the image-forming method according to the present invention the same or different or a mixture of different developing accelerators may be added to at least one of the hydrophilic layers at the emulsion side. More preferably at least one development accelerator is added to at least one of the protective layers, preferably to the topcoat layer.

Development acceleration may be accomplished with the aid of various compounds, preferably polyoxyalkylene derivatives having a molecular weight of at least 400 such as those described in e.g. U.S. Pat. Nos. 3,038,805; 4,038,075 and 4,292,400 and in EP-A 0 634 688. Especially preferred developing accelerators are polyoxyethylenes containing (recurrent) thioether groups as disclosed e.g. in DE 1 522 396, in DE 2 360 878 and in EP-A 0 674 215, wherein the said applications are related with development acceleration of materials comprising AgBr and/or AgBr(I) emulsions.

The photographic hardcopy material used in the image-forming method according to the present invention may further comprise various other additives such as e.g. compounds improving the dimensional stability of the photographic element, UV-absorbers, spacing agents, hardeners, and plasticizers.

Plasticizers suitable for incorporation in the emulsions according to the present invention are e.g. glycol, glycerine, or the latexes of neutral film forming polymers including polyvinyl-acetate, acrylates and methacrylates of lower alkanols e.g. polyethylacrylate and polybutylmethacrylate.

Suitable additives for improving the dimensional stability of the photographic hardcopy film may be i.a. dispersions of a water-soluble or hardly soluble synthetic polymer e.g. polymers of alkyl(meth)acrylates, alkoxy(meth)acrylates, glycidyl (meth)acryla-tes, (meth)acrylamides, vinyl esters, acrylonitriles, olefins, and styrenes, or copolymers of the above with acrylic acids, methacrylic acids, α-β-unsaturated dicarboxylic acids, hydroxyalkyl (meth)acry-lates, sulphoalkyl (meth)acrylates and styrene sulphonic acids.

Suitable UV-absorbers may be i.a. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455.

In general, the average particle size of spacing agents is comprised between 0.2 and 10 μm. Spacing agents may be soluble or insoluble in alkali. Alkali-insoluble spacing agents usually remain permanently in the photographic element, whereas alkali-soluble spacing agents usually are removed therefrom in an alkaline processing bath. Suitable spacing agents may be made i.a. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

Matting agents present in the material for use in the image-forming method according to the present invention are polymethylmethacrylate and/or silicium dioxide particles with a particle size diameter from 0.01 to 5 μm and more preferably from 0.025 to 2 μm that are added to protective topcoat layer.

Prior to coating any thickening agent may be used in order to regulate the viscosity of the coating solution, provided that they do not particularly affect the photographic characteristics of the silver halide light-sensitive photographic material. Preferred thickening agents include aqueous polymers such as polystyrene sulphonic acid, dextran, sulphuric acid esters, polysaccharides, polymers having a sulphonic acid group, a carboxylic acid group or a phosphoric acid group as well as colloidal silica.

Polymeric thickeners well-known from the literature resulting in thickening of the coating solution may be used independently or in combination, even with colloidal silica. Amounts may be suitably selected according to the kinds of silver halide (silver chloride, silver chloroiodide, silver chlorobromide or silver chlorobromoiodide in this case) and the kinds of layers or compounds to which these thickening agents are to be added. Patents concerning thickening agents are U.S. Pat. No. 3,167,410; Belgian Patent No. 558.143 and JP OPI Nos. 53-18687 and 58-36768. Negative effects on physical stability possibly resulting from the addition of polymeric compounds can be avoided by exclusion of those compounds and by restricting extra additions of colloidal silica.

The emulsions prepared and coated in the photographic hardcopy material used in the image-forming method according to the present invention are particularly advantageous for the formation of very thin emulsion layers e.g. layers with a layer thickness of less than 5 μm, containing less than 5 g of gelatin, preferably about 3 and more preferably about 2 g/m$^2$. Such thin coated layers offer the advantage that besides the rapid processing applicability and the rapid drying of the wet processed material an improvement in sharpness is observed.

The photographic elements used in the image-forming method of the present invention may further comprise various kinds of surface-active agents in the photographic emulsion layer or in at least one other hydrophilic colloid layer. Suitable surface-active agents include non-ionic agents such as saponins, alkylene oxides as e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides; anionic agents comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic or heterocyclic quaternary ammonium salts, aliphatic or heterocyclic ring-containing phosphonium or sulphonium salts. Such surface-active agents may be used for various purposes e.g. as coating aids, as compounds preventing electric charges, as compounds improving slidability, as compounds facilitating dispersive emulsification, as compounds preventing or reducing adhesion.

Since the drying characteristics in the processor are mainly determined by the water absorption of the hydrophilic layers of the photographic material, and since the water absorption is directly proportional to the gelatin content of the layers and inversely proportional to the amount of hardener, added to the layer, its composition is optimized with a low a low gelatin content and a high hardening degree in order to attain the object of this invention to allow hardener free processing within a from 30 to at most 50 seconds dry-to-dry cycle time.

In a preferred embodiment, a total amount of gelatin of less than 3 g/m$^2$ per side is present.

Hardeners may be added to the antistress layer before or during the coating procedure. The binders of the photographic element, especially when the binder used is gelatin, can be hardened with appropriate hardening agents such as those of the epoxide type, those of the ethylenimine type, those of the vinylsulfone type e.g. 1,3-vinylsulphonyl-2-propanol, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydro-xy-dioxan, active vinyl compounds e.g. 1,3,5-triacryloyl-hexa-hydro-s-triazine, active halogen compounds e.g. 2,4-dichloro-6-hydroxy-s-triazine, and mucohalogenic acids e.g. mucochloric acid and mucophenoxy-chloric acid. These hardeners can be used alone or in combination. The binders can also be hardened with fast-reacting hardeners such as carbamoylpyridinium salts.

Preferred hardening agents used in the hardcopy material suitable for use in the image-forming method according to the present invention are formaldehyd and phloroglucinol, added respectively to the protective layer(s) and to the emulsion layer(s). In another embodiment other preferred hardening agents are bis-vinyl-sulphonyl-methyl-ether (BVSME) or ethylene-bis-vinyl-sulphone.

The hardcopy material used in the image-forming method according to the present invention has a hardening degree corresponding with a water absorption of the unexposed material of less than 10 g/m$^2$, and more preferably from 4 to 7 g/m$^2$ after immersion in demineralized water at 24° C. during 10 minutes following the method described hereinbefore.

Backing layers applied to the material having at least one emulsion layer at one side of the hardcopy material used in the image-forming method according to the present invention essentially contain hydrophilic colloids, one or more antihalation dye(s), matting agent(s), surfactant(s), antistatic agent(s), lubricant(s) and hardening agent(s).

Amounts of hydrophilic colloids are chosen in order to prevent curl of the single side emulsion coated material, such as in U.S. Pat. No. 5,155,013. Also non-swelling hydrophobic polymers can be used in the backing layer as has e.g. been described in U.S. Pat. No. 5,326,686. Further measures to prevent curling have been disclosed e.g. in JP-A's 02024645; 02085847 and 02087138.

A common support of the photographic silver halide emulsion hardcopy material used in the image-forming method according to the present invention is a hydrophobic resin support. Hydrophobic resin supports are well known to those skilled in the art and are made e.g. of polyester, polystyrene, polyvinyl chloride, polycarbonate, preference being given to polyethylene terephthalate and polyethylene naphthalate.

The hydrophobic resin support may be provided with one or more subbing layers known to those skilled in the art for adhering thereto a hydrophilic colloid layer. Suitable subbing layers for polyethylene terephthalate supports are described e.g. in U.S. Pat. Nos. 3,397,988, 3,649,336, 4,123,278 and 4,478,907.

Coating of the different layers of the photographic hardcopy element used in the image forming method of the present invention may occur according to any of the known techniques for applying photographic coatings. In particular modern slide hopper and especially curtain coating techniques are applied. In order to increase the coating speed and/or to reduce the coating thickness when using curtain coating, polyacrylamides which are known to increase the shear viscosity can be added to the coating composition of the emulsion layer and/or protective antistress layer. Suitable polyacrylamides are copoly(acrylamide-(meth)acrylic acid), e.g., COPOLY(acrylamide-acrylic acid-sodium acrylate) (87.5:4.1:8.4) in particular the commercial products ROHAFLOC SF710 and ROHAFLOC SF 580 from ROHM. These polyacrylamides are preferably used in amounts of 10 to 500 ppm in the coating composition of the antistress layer and coating occurs simultaneously with the emulsion layer by curtain coating. In this way the emulsion layer thickness can be reduced and coating can proceed at increased speed.

As it has been a further object of this invention to have the disposal of a convenient imaging system wherein the light-sensitive hardcopy material rich in silver chloride of a medical, electronically stored image, perfectly fits, the said convenient imaging system in accordance with this invention is characterized by the following consecutive handling steps of the hardcopy material described hereinbefore:

- introduction of the said hardcopy material having preferred format sizes of 14"×17" in an exposure station;
- exposure of said hardcopy material with a red or infrared (gas or semiconductor) laser source within a time of less than or equal to 10 s;
- transport of said hardcopy material to an automatic processing station within a time of less than 5 s;
- processing dry-to-dry of said hardcopy material in said automatic processor within a time of from 30 to less than 50 s.

In these conditions the imaging system provides at least 4 consecutive sheets having a size format of 17"×14" per minute of a light-sensitive hardcopy material of medical, electronically stored images.

Especially a short exposure time with a laser source, taking less than or equal to 10 seconds for the said film format size for the hardcopy material in accordance with this invention, is particularly advantageous to reach the objectives of this invention. Suitable lasers may be gas lasers or solid state lasers. As a suitable gas laser a helium/neon gas laser is preferred (absorption maximum 633 nm). As a preferred solid state laser an infrared laser diode having a more bathochrome absorption maximum at 820 nm is used. As a preferred laser imager fulfilling the mentioned advantages we refer to the laser imager MATRIX LR 3300, trade name product marketed by Agfa-Gevaert.

The processing dry-to-dry within a time of from 30 to less than 50 seconds of the hardcopy material in accordance with the present invention is made possible by the steps of

- developing said hardcopy material in a developer without hardening agent;
- fixing said hardcopy material in a fixer without hardening agent;
- rinsing and drying the said hardcopy material.

Thanks to the special composition of the hardcopy material in the image-forming method according to the present invention, said material having a high degree of hardening as reflected by the reduced amount of water absorption disclosed hereinbefore, it is possible to make use of the said hardener free processing solutions.

Developers and fixers for use in the processing cycle of the hardcopy material according to the method of the present invention have been described in EP-A's 0 732 619 and 0 731 381, which are incorporated herein by reference. Opposite to the developer compositions used in U.S. Pat. Nos. 3,865,591 and 5,464,730 the presence of hydroquinone, known as an ecologically unpleasant developing agent, is not required and should be considered as a particular advantage offered by the present invention.

In a preferred embodiment the compound according to formula (I) mentioned hereinbefore corresponds to (iso) ascorbic acid, 1-ascorbic acid and tetramethyl reductic acid.

In a further preferred embodiment developing proceeds with a solution comprising a hydroquinone and a compound corresponding to formula (I) in a ratio by weight of up to 9:1 and more preferably of up to 1:1.

In another embodiment said development processing proceeds with a solution comprising thiocyanate ions in amounts between $10^{-3}$ and $10^{-1}$ molar and/or in amounts of from 0.1 to 5 g per liter a compound corresponding to the formula (II), accompanied by charge compensating anions,

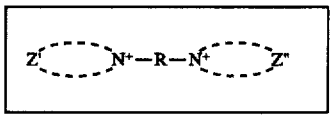

(II)

wherein at least divalent group R contains at least one oxyethylene group and wherein Z' and Z", being the same or different, are composed of enough atoms to form a heterocyclic aromatic 5- or 6-ring. In a preferred embodiment in the formula (II) the said heterocyclic aromatic rings are the same or different and represent a pyridine, a pyrimidine, an imidazol, a benzimidazol, a thiazol, a benzothiazol or a derivative thereof. Especially use of pyridinium salts is preferred. In a further embodiment at least one divalent group R represents at least 3 oxyethylene-units.

A particularly suitable developer solution for use in developing the hardcopy material within the scope of this invention is a so-called one-part "low-sludge" developer which comprises a reduced amount of sulphite and ascorbic acid, acting as a main developer and anti-oxidant (see Examples).

Analogously a suitable fixer solution for use in fixing the hardcopy material within the scope of the image-forming method according to the present invention is a fixer which comprises an amount of less than 25 g of potassium sulphite per liter without the presence of acetic acid and wherein said fixer has a pH value of at least 4.5, in order to make the fixer solution quasi odorless.

As coating amounts of emulsion crystals rich in chloride are reduced to an extremely low level, the fixation time is reduced to about 2 to 10 seconds.

Moreover it should be recommended to regenerate the developer solution and the fixer solution for use in the processing of the hardcopy material in the method according to the present invention with concentrates of developer solutions and fixer solutions. In these circumstances, no dilution and mixing procedures are required before the regeneration bottles are adjusted to the processing unit. Moreover regeneration is kept to a minimum as the processing of materials according to the present invention are coated from very low amounts of emulsion crystals rich in silver chloride. Preferred minimum regeneration or replenishment amounts are from 20 to 100 ml/m$^2$, more preferred from 25 to 75 ml/m$^2$ and still more preferred from 25 to 50 ml/m$^2$ of developed material.

Although silver halide materials comprising such fine cubic crystals rich in silver chloride are much more sensitive to the formation of sludge in a developer and/or fixer, it has been established that in the preferred developer used in the method of image-forming according to the present invention having a composition as described hereinbefore, a very low sludge level is attained.

Although it is possible to use whatever a processing unit adapted to the requirements described hereinbefore to reach the objectives concerning a perfect link between rapid processing and ecology, the objects of the present invention concerning processing have e.g. been realized in the processing unit CURIX HT 530, trade name product marketed by Agfa-Gevaert.

Especially if the said laser imager MATRIX LR 3300 is linked with the CURIX HT 330 processing unit on top of it, as has e.g. been realized in the laser imager processor MATRIX LR 3300P Laser Imager Processor, trade name product marketed by Agfa-Gevaert, the objectives of this invention can be fully realized. CURIX 330 again is a trade name product marketed by Agfa-Gevaert.

It is clear that within the scope of the present invention any combination of a laser imager and a processing unit may be used and is not limited to the laser imagers and processors described hereinbefore, the proviso that the respective requirements for both of them are fulfilled, in accordance with the objects of the present invention.

EXAMPLES

Example 1

This example demonstrates the advantages of emulsions comprising AgCl(Br) crystals over emulsions comprising AgBr(I) crystals, both having a small average grain size between 0.2 and 0.3 μm.

Preparation of Emulsion A

| | |
|---|---|
| Solution 1 | |
| Water | 2020 ml |
| Gelatin | 46 g |
| Sodium chloride | 4.6 g |
| Solution 2 | |
| Water | 1000 ml |
| Silver nitrate | 500 g |
| Solution 3 | |
| Water | 1000 ml |
| Sodium chloride | 168 g |
| Potassium bromide | 0.7 g |

To solution 1 at a constant temperature of 50° C., there was simultaneously added, while stirring, a part of solution 2 and of solution 3 over a period of 5 minutes at a flow rate of 20 ml/min, maintaining the pAg at a constant value of 7.30.

After this nucleation period the rest amounts of solution 2 and 3 were added simultaneously while stirring over a period of 1350 seconds at a linearly increasing flow rate varying from 20 ml/min to 60 ml/min, meanwhile maintaining the pAg at a constant value of 7.30.

The emulsion was washed with a solution of demineralized water containing 0.46 g of sodium chloride per liter after flocculation by addition of polystyrene sulphonic acid to the acidified emulsion. To the washed flocculate 130 g of gelatin was added, followed by redispersion.

In this way a cubic silverchlorobromide emulsion having a mean grain size of 0.23 μm and a chloride content of 98 mole % was obtained.

The pH of the said emulsion was adjusted at 5.15; the pAg at 7.00.

To the dispersion obtained as described hereinbefore 5 mg of para-toluene thiosulphonate, 1 g of potassium iodide, 15 mg of chloro auric acid, 30 mg of ammonium thiocyanate and 25 mg of tetramethylthio-dithiocarboxylic acid diamide were added at 40° C.

Chemical sensitization was carried out at 52° C. to give an optimum sensitivity-fog relationship.

Preparation of Emulsion B

A cubic silver chlorobromide emulsion having a mean grain size of 0.26 μm and a silver chloride content of 98 mole % was prepared in the same way as described hereinbefore for the preparation of the Emulsion A except for:

a nucleation flow rate which was held at 14 ml/min;

the rest of solution 2 and 3 respectively which was added simultaneously over a period of 1508 seconds at a linearly increasing flow rate changing from 14 to 60 ml/min.

the chemical sensitization which was performed with the same products in different amounts: taking into account the size of the emulsion crystals amounts of the ripening agents were multiplied with a factor of 0.885.

Preparation of Emulsion C

A cubic silver chlorobromide emulsion having a mean grain size of 0.28 μm and a silver chloride content of 98 mole % was prepared in the same way as described hereinbefore for the preparation of the Emulsion A except for:

the nucleation flow rate which was changed to 11 ml/min;

the rest of solution 2 and 3 respectively which was added simultaneously over a period of 1597 seconds at a linearly increasing flow rate changing from 11 to 60 ml/min.

the chemical sensitization which was performed with the same products in different amounts: taking into account the size of the emulsion crystals amounts of the ripening agents were multiplied with a factor of 0.821.

Preparation of Emulsion D

A cubic silver chlorobromide emulsion having a mean grain size of 0.32 μm and a silver chloride content of 98 mole % was prepared in the same way as described hereinbefore for the preparation of the Emulsion A except for:

the nucleation flow rate which was changed to 7.5 ml/min;

the rest of solution 2 and 3 respectively which was added simultaneously over a period of 1711 seconds at a linearly increasing flow rate changing from 7.5 to 60 ml/min;

the chemical sensitization which was performed with the same products in different amounts. Taking into account the size of the emulsion crystals amounts of the ripening agents were multiplied with a factor of 0.719.

Preparation of Emulsion E

A cubic silver chlorobromide emulsion having a mean grain size of 0.39 μm and a silver chloride content of 98 mole % was prepared in the same way as in the preparation of the Emulsion A except for:

the nucleation flow rate which was changed to 4 ml/min;

the rest of solution 2 and 3 respectively which was added simultaneously over a period of 1838 seconds at a linearly increasing flow rate changing from 4 to 60 ml/min;

the chemical sensitization which was performed with the same products in different amounts: taking into account the size of the emulsion crystals amounts of the ripening agents were multiplied with a factor of 0.590.

Preparation of Comparative Emulsion F

| | |
|---|---|
| Solution 4 | |
| Water | 920 ml |
| Gelatin | 50 g |
| Methionin | 0.5 g |
| Potassium bromide | 40 mg |
| Solution 5 | |
| Water | 485 ml |
| Silver nitrate | 242.5 g |
| Solution 6 | |
| Water | 485 ml |
| Potassium bromide | 163 g |
| Potassium iodide | 9.75 g |

To solution 4, kept at a constant temperature of 60° C., there were simultaneously added a part of the solutions 5 and 6, meanwhile stirring over a period of 5 minutes at a flow rate of 8 ml/min; maintaining the pAg at a constant value of 6.8. After this nucleation period the rest amounts of solutions 5 and 6 were added simultaneously under stirring conditions over a period of 1404 seconds at a linearly increasing flow rate changing from 8 to 30 ml/min, maintaining the pAg at a constant value of 6.8.

Subsequently, the following solutions 7 and 8 were added thereto simultaneously over a time interval of 1236 seconds at a linearly increasing flow rate changing from 20 ml/min to 30 ml/min maintaining the pAg at a constant value of 6.8.

| | |
|---|---|
| Solution 7 | |
| Water | 515 ml |
| Silver nitrate | 257.5 g |
| Solution 8 | |
| Water | 515 ml |
| Potassium bromide | 180 g |

The emulsion was washed with a solution of demineralized water containing 0.46 g of sodium chloride per liter after flocculation by addition of polystyrene sulphonic acid to the acidified emulsion. To the washed flocculate 130 g of gelatin was added, followed by redispersion. The emulsion was washed with water after application of a conventional flocculation method as described for emulsion A. An amount of 126 g of gelatin was added thereto.

A cubic silver bromoiodide emulsion having a mean grain size of 0.23 μm was obtained having a bromide content of 98 mole %.

The pH of the emulsion was adjusted to 6.5, the pAg thereof was adjusted to 7.00 and the temperature was raised to 50° C. Added amounts of ripening agents were: 8 mg of sodium thiosulphate, 21 mg of chloro auric acid, 42 mg of ammonium thiocyanate and 8 mg of para-toluene thiosulphonate. Chemical sensitization was carried out at 50° C. to give an optimum fog-sensitivity relationship.

Preparation of Emulsion G

A cubic silver bromoiodide emulsion having a mean grain size of 0.25 μm and a silver bromide content of 98 mole % was prepared in the same way as described hereinbefore for the preparation of the Emulsion F except for:

the amount of methionin in solution 4 which changed to 1 g;

the chemical sensitization which was performed with the same chemical ripening agents the amounts of which were multiplied with a factor 0.920 in order to compensate for the real emulsion crystal size.

Preparation of Emulsion H

A cubic silver bromoiodide emulsion having a mean grain size of 0.27 μm and a silver bromide content of 98 mole % was prepared in the same way as described hereinbefore for the preparation of the Emulsion F except for:

the amount of methionin in solution 4 which was changed to 2 g;

the chemical sensitization which was performed with the same chemical ripening agents the amounts of which were multiplied with a factor 0.852 in order to compensate for the real emulsion crystal size.

Preparation of Reference Emulsion I

A cubic silver bromoiodide emulsion having a mean grain size of 0.33 μm and a silver bromide content of 98 mole % was prepared in the same way as described in the preparation method of Emulsion F except for:

the amount of methionin in solution 4 which changed to 6 g;

the chemical sensitization which was performed with the same products but in amounts which were multiplied with a factor 0.700 in order to compensate for the real emulsion crystal size.

Preparation of Coated Samples

AgCl(Br) emulsions

A sensitizing dye (Sensitizing Dye (1)) was added in a amount of 0.16 mmole per mole of silver to each of the Emulsions A to E. In this way the emulsions were sensitized in order to become sensitive to red light. Further, 50 mg (per mole of Ag) of an antifading agent (Compound (1)) was added, 65 mg (per mole of Ag) of 1-phenyl-5-mercaptotetrazole and 260 mg (per mole of Ag) of 1-p-carboxy-phenyl-5-mercaptotetrazole were added as stabilizers and 106 mg (per mole of Ag) fluoroglucinol as a surfactant were added together with polymethyl acrylate latex (in an amount of 140% based on the weight amount of gelatin binder) used as a plasticizer.

AgBr(I) emulsions

4-Hydroxy-6-methyl-1,3,3a-tetra-azaindene was added in a amount of 11.6 mmole per mole of silver to each of the emulsions F to I. Further, the sensitizing dye (Sensitizing Dye (1)) was added in a amount of 0.12 mmole per mole of silver. In this way the emulsions were made sensitive to red light. Consecutively, in an amount of 106 mg (per mole of Ag) fluoroglucinol was added as a surfactant, together with polymethyl acrylate latex (in an amount of 140% by weight, based on the amount of gelatin binder) used as a plasticizer. The thus prepared emulsion coating solutions were coated on a polyethylene terephthalate support in such an amount in order to give a coating weight of 4.8 g/m$^2$ in terms of $AgNO_3$ and 2 g of gelatin per m$^2$.

Further, the following protective layer was coated thereupon at a pH value of 6.1:

| Protective layer | |
|---|---|
| Gelatin | 1.1 g/m$^2$ |
| Polyethyl acrylate latex | 500 mg/m$^2$ |
| Kieselsol | 15 mg/m$^2$ |
| Chromium acetic acid | 5.5 mg/m$^2$ |
| Compound (2) | 7.5 mg/m$^2$ |
| Compound (3) | 19 mg/m$^2$ |
| Mobilcer Q | 25 μl/m$^2$ |
| Compound (4) | 8 mg/m$^2$ |

Sensitizing Dye (1):

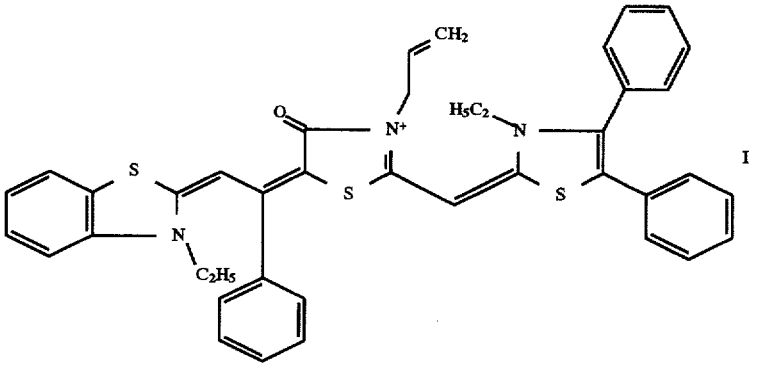

Compound (1):

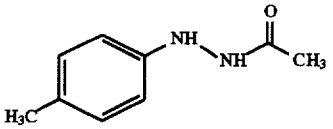

Compound (2):

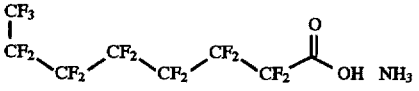

Compound (3):

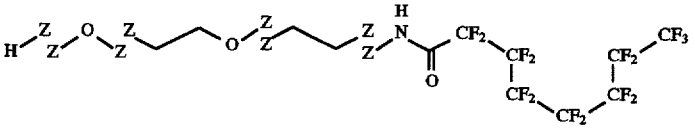

-continued

Compound (4):

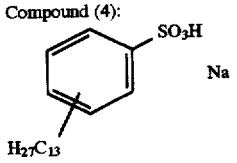

Evaluation of the Coated Samples

The coated samples were exposed with a HeNe-laser beam (633 nm) during a time of $5\times10^{-7}$ seconds and were processed for 11" at 35° C. in G138, tradename of the developer marketed by Agfa-Gevaert N.V., or, in the alternative, in DEV1, having the following composition:

| DEV1 | |
|---|---|
| 1-phenyl-4-methyl-4'hydroxymethyl-3-pyrazolidine-1-one | 2 g/l |
| Sodium EDTA | 2 g/l |
| Potassium bromide | 3.3 g/l |
| Potassium thiocyanate | 1 g/l |
| Potassium sulphite | 33 g/l |
| Potassium carbonate | 96 g/l |
| Polyglycol (M.W. = ca. 400) | 20 ml/l |
| Compound (5) | 1 g/l |
| Ascorbic Acid | 50 g/l |
| pH ready-for-use | 10.0 |

Compound (5):

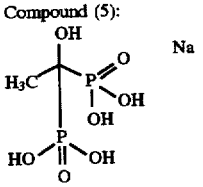

The developed samples were fixed in G334, tradename of the corresponding fixer, marketed by Agfa-Gevaert N.V., followed by rinsing with water.

The color "hue" of the developed silver was evaluated qualitatively and quantitatively: the ratio was calculated from the densities obtained by measurement of the said densities at total density of 2.5 through a filter transparent for blue and red light respectively. The lower this ratio value "DBR", the more preferred is the image tone of the developed silver. Application of this method evaluates the transmission characteristics of the hue of the developed material in a quantitative manner.

The "covering power" is the ratio of the maximum density and the amount of developed silver measured in the same density region. The higher the covering power, the less silver is required in order to provide a good maximum density. As a consequence thereof the developability will be better and regeneration amounts of the developer and fixer per square meter will be smaller.

The results obtained are shown in Table I.

As can been seen from Table I hereinafter, in G138, the materials coated from AgBr(I) emulsions (Emulsions F to I) show an increasingly disturbing brownish color upon examination, when the average emulsion grain size is decreasing. This makes them useless for practical applications as a hard copy material.

TABLE I

| Emulsion | Composition | Mean grain size | Developer | DBR | Covering power |
|---|---|---|---|---|---|
| F (comp.) | AgBr (I) | 0.23 | G138 | 1.016 | 0.95 |
| G | AgBr (I) | 0.25 | G138 | 1.000 | 0.85 |
| H | AgBr (I) | 0.27 | G138 | 0.984 | 0.81 |
| I (ref.) | AgBr (I) | 0.33 | G138 | 0.950 | 0.70 |
| A (inv.) | AgCl (Br) | 0.23 | G138 | 0.880 | 0.97 |
| B | AgCl (Br) | 0.26 | G138 | 0.868 | 0.90 |
| C | AgCl (Br) | 0.28 | G138 | 0.871 | 0.83 |
| D | AgCl (Br) | 0.32 | G138 | 0.868 | 0.74 |
| E | AgCl (Br) | 0.39 | G138 | 0.960 | 0.64 |
| F | AgBr (I) | 0.23 | DEV1 | 0.984 | 0.93 |
| G | AgBr (I) | 0.25 | DEV1 | 0.980 | 0.84 |
| H | AgBr (I) | 0.27 | DEV1 | 0.969 | 0.82 |
| I | AgBr (I) | 0.33 | DEV1 | 0.943 | 0.70 |
| A | AgCl (Br) | 0.23 | DEV1 | 0.906 | 1.07 |
| B | AgCl (Br) | 0.26 | DEV1 | 0.912 | 0.99 |
| C | AgCl (Br) | 0.28 | DEV1 | 0.909 | 0.95 |
| D | AgCl (Br) | 0.32 | DBV1 | 0.916 | 0.87 |
| E | AgCl (Br) | 0.39 | DEV1 | 0.919 | 0.76 |

Opposite thereto the materials coated from AgCl(Br) emulsions (Emulsions A to E) don't show this disadvantage: a suitable black color hue or image tone is obtained. As a consequence this makes them suitable as a hard copy material coated from small amounts of silver per square meter, even if AgCl(Br) emulsions having a small average grain size are coated. This further corresponds with the results obtained from the transmission hue ratio values "DBR" measured for the samples developed in the developer DEV1.

It is however remarkable that the samples coated from AgBr(I) emulsions (Emulsions F to I), which are not suitable for use within the scope of this invention, show a better color hue in DEV1 if compared with the corresponding results for the same samples obtained in G138, whereas the color hue of the samples coated from AgCl(Br) emulsions (Emulsions A to E) become worse but remain acceptable in DEV1 if compared with the color hue obtained after development in G138.

As can further be concluded from Table I, there is no difference between the covering power of a AgCl(Br) or a AgBr(I) emulsion of the same average grain size if they are developed in G138. However, development in DEV1 causes an increase in covering power for the AgCl(Br) emulsions (Emulsions A to E), while the covering power of the AgBr(I) emulsions (Emulsions F to I) for a development in the latter developer remains the same if compared with the covering power obtained after development in G138.

It has also been found that in DEV1 coatings from AgCl(Br) emulsions show a decrease of 50% in silver sludge after development if compared with the result obtained for the same coatings in G138.

Use of Emulsion A in combination of DEV1 may further cause a decrease in the amount of coated silver of 35% if compared with the reference Emulsion I, developed in the reference developer G138.

Example 2

This example demonstrates the positive influence of an iridium dopant incorporated into the crystal lattice of silver chloride or chlorobromide emulsions on the development latitude.

Preparation of Emulsion J

A cubic silver chlorobromide emulsion having an average grain size of 0.23 μm and a silver chloride content of 98 mole % was prepared in the same way as described for the preparation of the Emulsion A except for the addition of $4.7\times10^{-6}$ mole of potassium hexachloroiridate(III) to solution 3.

Preparation of Emulsion K

A cubic silver chlorobromide emulsion having an average grain size of 0.23 μm and a silver chloride content of 98 mole % was prepared in the same way as described for the preparation of the Emulsion A except for the addition of $9.4\times10^{-6}$ mole of potassium hexachloroiridate(III) to solution 3.

Preparation of Emulsion L

A cubic silver chlorobromide emulsion having an average grain size of 0.23 μm and a silver chloride content of 98 mole % was prepared in the same way as described for the preparation of the Emulsion A except for the addition of $1.6\times10^{-5}$ mole potassium hexachloroiridate(III) to solution 3.

The emulsions J, K and L were coated and exposed as described for the AgCl(Br) emulsions in Example 1.

The Sensitometric Evaluation:

The sensitometric evaluation measured after development of the coatings of emulsions A, J, K and L in DEV1, is shown in Table II: S1 and S3 are the sensitivities measured at density 1.00, respectively 3.00, above fog level. G1 and G2 are the average gradients between densities of 0.40 and 1.00 above fog, and between densities 1.80 and 2.40 above fog, respectively.

TABLE II

| Em. | Ir-comp. (μmole/ mole of Ag) | Devel. time | Devel. temp. | Fog × 1000 | S1 | S3 | G1 | G2 |
|---|---|---|---|---|---|---|---|---|
| A | 0 | 11" | 30° C. | 5 | 139 | 183 | 275 | 509 |
| A | 0 | 11" | 33° C. | 14 | 123 | 160 | 303 | 600 |
| A | 0 | 11" | 36° C. | 28 | 115 | 150 | 307 | 625 |
| J | 1.6 | 11" | 30° C. | 0 | 150 | 184 | 364 | 616 |
| J | 1.6 | 11" | 33° C. | 1 | 144 | 176 | 362 | 679 |
| J | 1.6 | 11" | 36° C. | 4 | 139 | 171 | 356 | 690 |
| K | 3.2 | 11" | 30° C. | 0 | 159 | 195 | 316 | 628 |
| K | 3.2 | 11" | 33° C. | 4 | 152 | 187 | 323 | 605 |
| K | 3.2 | 11" | 36° C. | 7 | 148 | 181 | 320 | 642 |
| L | 5.3 | 11" | 30° C. | 2 | 165 | 205 | 295 | 533 |
| L | 5.3 | 11" | 33° C. | 4 | 159 | 199 | 283 | 534 |
| L | 5.3 | 11" | 36° C. | 7 | 156 | 198 | 275 | 549 |
| A | 0 | 11" | 35° C. | 25 | 119 | 157 | 304 | 590 |
| A | 0 | 16" | 35° C. | 46 | 109 | 143 | 315 | 660 |
| A | 0 | 21" | 35° C. | 81 | 115 | 150 | 307 | 625 |
| J | 1.6 | 11" | 35° C. | 3 | 140 | 171 | 363 | 741 |
| J | 1.6 | 16" | 35° C. | 8 | 134 | 165 | 377 | 682 |
| J | 1.6 | 21" | 35° C. | 18 | 129 | 163 | 378 | 623 |
| K | 3.2 | 11" | 35° C. | 6 | 149 | 183 | 325 | 615 |
| K | 3.2 | 16" | 35° C. | 14 | 141 | 176 | 334 | 672 |
| K | 3.2 | 21" | 35° C. | 24 | 136 | 175 | 341 | 522 |
| L | 5.3 | 11" | 35° C. | 7 | 157 | 196 | 281 | 559 |
| L | 5.3 | 16" | 35° C. | 15 | 149 | 188 | 300 | 542 |
| L | 5.3 | 21" | 35° C. | 23 | 145 | 191 | 295 | 452 |

As can be concluded from Table II the materials coated from iridium-doped emulsion crystals show a remarkable and unexpected decrease in the dependence of sensitometry upon the development conditions (e.g. development time and temperature).

Example 3

This Example demonstrates that the use of iridium dopants in the preparation of AgCl(Br) emulsion crystals has a much larger positive effect on the processing latitude than with iridium doped AgBr(I) emulsions.

Preparation of Emulsion M

A cubic silver bromoiodide emulsion having an average grain size of 0.23 μm and a silver chloride content of 98 mole % was prepared in the same way as described in the preparation method of the Emulsion F except for the addition of $7.8\times10^{-6}$ mole of potassium hexachloroiridate(III) to solution 6 and $8.2\times10^{-6}$ mole of potassium hexachloroiridate(III) to solution 8.

The emulsion M was coated and exposed as has been described for the AgBr(I) emulsions in Example 1.

Table III lists the sensitometric differences obtained after development at a temperature of 30° C. and 36° C. respectively during 11 seconds in DEV1.

TABLE III

| Emulsion | Composition | Ir-compound (μmole per mole of Ag) | ΔFog × 1000 | ΔS1 | ΔS3 | Δ % G1 | Δ % G2 |
|---|---|---|---|---|---|---|---|
| A | AgCl (Br) | 0 | 23 | 24 | 33 | 112 | 123 |
| L | AgCl (Br) | 5.3 | 5 | 9 | 7 | 93 | 103 |
| F | AgBr (I) | 0 | 6 | 14 | 20 | 108 | 125 |
| M | AgBr (I) | 5.3 | 7 | 11 | 13 | 99 | 96 |

As can be concluded from Table III, the effect of the iridium-dopant on the sensitivity for a AgBr(I) emulsion (Emulsion M) is negligible if compared with the effect obtained for a AgCl(Br) emulsion in the same conditions.

Example 4

This Example demonstrates the improvement in sensitivity when a selenium compound is added during chemical sensitization. Emulsion A was chemically sensitized with Se as follows:

Preparation of Emulsion A2:

A cubic silver chlorobromide emulsion having an average grain size of 0.23 μm and a silver chloride content of 98 mole % was prepared in the same way as in the preparation of Emulsion A except for the addition of 1 mg of compound (6) and the performance of the chemical sensitization at 50° C.

Compound (6):

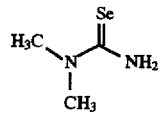

Preparation of Emulsion A3:

A cubic silver chlorobromide emulsion having an average grain size of 0.23 μm and a silver chloride content of 98 mole % was prepared in the same way as in the preparation of the Emulsion A except for the addition of 2.5 mg of compound (7) and the temperature of the chemical sensitisation being 50° C.

Compound (7):

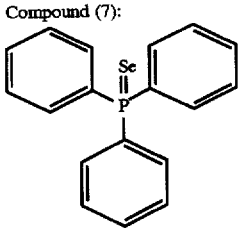

Preparation of Emulsion A4:

A cubic silver chlorobromide emulsion having an average grain size of 0.23 μm and a silver chloride content of 98 mole % was prepared in the same way as in the preparation of the Emulsion A except for the absence of ammonium thiocyanate in this preparation method. 1 mg of compound (6) was further added and the chemical sensitization was carried out at 50° C.

Preparation of Emulsion A5:

A cubic silver chlorobromide emulsion having an average grain size of 0.23 μm and a silver chloride content of 98 mole % was prepared in the same way as in the preparation of the Emulsion A except for the absence of ammonium thiocyanate. 2.5 mg of compound (7) was added and the chemical sensitization was carried out at 50° C.

Table IV shows the results obtained after development for 11 seconds in DEV1 at 35° C. for the coatings of the emulsions A and A2–A5 differing in chemical sensitisation:

TABLE IV

| Emulsion | Fog × 1000 | S1 | S3 | G1 | G2 |
|---|---|---|---|---|---|
| A | 0 | 135 | 168 | 355 | 585 |
| A2 | 18 | 109 | 146 | 294 | 584 |
| A3 | 19 | 110 | 147 | 294 | 589 |
| A4 | 6 | 120 | 156 | 314 | 597 |
| A5 | 0 | 123 | 159 | 327 | 602 |

As can be concluded from Table IV, chemical sensitization in presence of a selenium compound makes sensitivity increase.

Example 5

This Example demonstrates that the AgCl(Br) emulsion is suitable for use in silver halide photographic materials sensitive for infrared radiation.

An infrared sensitizing dye (Sensitising Dye (2)) was added in a amount of 0.08 mmole/mole of Ag to the Emulsion A after addition of compound (8), which was added in a amount of 2.2 mmole/mole of Ag.

The emulsions were made sensitive to infrared radiation. Coating solutions were added and the coating procedure was further performed as has been described in Example 1.

Sensitizing Dye (2):

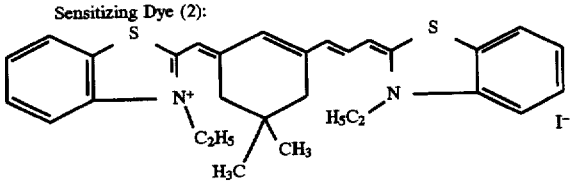

-continued

Compound (8):

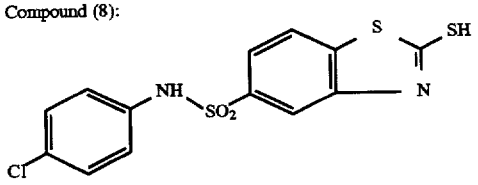

This sample was exposed with an infra red laserdiode (820 nm), processed and evaluated as has been described in Example 1. Table V shows the sensitometric data of the red sensitized (HeNe) and infrared sensitized Emulsion A.

TABLE V

| Spectral sensitization and exposure source | Fog × 1000 | S1 | S3 | G1 | G2 |
|---|---|---|---|---|---|
| HeNe (633 nm) | 0 | 135 | 168 | 355 | 585 |
| IR (820 nm) | 0 | 160 | 209 | 334 | 437 |

Table V demonstrates that the AgCl(Br) emulsions are also suitable for infrared applications.

Example 6

This example makes a comparison between development in a developer comprising hydroquinone and a developer comprising ascorbic acid as main developing agents.

DEV2 has the following composition:

| DEV2 | |
|---|---|
| 1-phenyl-4-methyl-3-pyrazolidine-1-one | 0.8 g/l |
| Sodium EDTA | 2 g/l |
| Potassium bromide | 2.5 g/l |
| Potassium isothiocyanate | 1 g/l |
| Potassium iodide | 0.1 g/l |
| Potassium sulphite | 100 g/l |
| Potassium carbonate | 30 g/l |
| Polyglycol (M.W. = ca. 400) | 20 ml/l |
| Compound (5) | 1 g/l |
| Hydroquinone | 20 g/l |
| pH ready-for-use | 10.5 |

The sensitometric data are shown in Table VI for DEV1 and DEV2 after development for 11 seconds at 35° C. for coatings from Emulsion A and J, the preparation, exposure and evaluation conditions of which have been described in Examples 1 and 2.

TABLE VI

| Emulsion | Developer | Fog × 1000 | S1 | S3 | G1 | G2 |
|---|---|---|---|---|---|---|
| A | DEV1 (AA) | 8 | 131 | 172 | 301 | 486 |
| A | DEV2 (HQ) | 10 | 128 | 175 | 288 | 372 |
| J | DEV1 (AA) | 0 | 159 | 190 | 314 | 707 |
| J | DEV2 (HQ) | 1 | 155 | 190 | 305 | 624 |

As can be concluded from table VI, DEV1 (Ascorbic acid) and DEV2 (Hydroquinone) have a comparative developing performance.

Example 7

This example demonstrates that superior sensitometric results can be obtained for silver halide photographic materials coated from a AgCl(Br) emulsion and developed in a suitable developer designed therefor in comparison with a silver halide photographic material coated from a AgBr(I) emulsion, developed in the standard developer G138. Table VII shows the results after development for 11 seconds at 36° C. for materials coated from Emulsions A, F, J and M.

As can be concluded from Table VII hereinafter, materials coated from Emulsions A and J (AgCl(Br)) show a superior sensitometry if they are processed in DEV1 if compared with materials coated from Emulsions F and M (AgBr(I)) processed in DEV1.

TABLE VII

| Em. | Comp. | Ir-comp. (μmole/mole of Ag) | Developer | Fog × 1000 | S1 | S3 | G1 | G2 |
|---|---|---|---|---|---|---|---|---|
| A | AgCl(Br) | 0 | G138 | 0 | 159 | 225 | 202 | 313 |
| F | AgBr(I) | 0 | G138 | 8 | 169 | 218 | 234 | 416 |
| J | AgCl(Br) | 1.6 | G138 | 5 | 175 | 215 | 273 | 533 |
| M | AgBr(I) | 5.3 | G138 | 10 | 180 | 217 | 280 | 626 |
| A | AgCl(Br) | 0 | DEV1 | 17 | 126 | 163 | 298 | 584 |
| F | AgBr(I) | 0 | DEV1 | 1 | 156 | 190 | 297 | 643 |
| J | AgCl(Br) | 1.6 | DEV1 | 7 | 158 | 192 | 302 | 649 |
| M | AgBr(I) | 5.3 | DEV1 | 0 | 172 | 207 | 313 | 592 |

Example 8

This Example demonstrates that the regeneration of the developer for a material comprising silver chlorobromide emulsions can be decreased in comparison with a material comprising silver bromoiodide emulsions.

By making use of a regeneration amount of 50 ml per sq.m. for the developer DEV1 the sensitivity S1 remained constant with an accuracy of ca. 2 sensitivity points during exhaustion of 500 $m^2$ of a material containing Emulsion A.

For the processing of 500 $m^2$ of the silver bromoiodide material (Emulsion I) a regeneration rate for the developer G138 of 200 ml per sq.m. is required in order to obtain the same sensitivity accuracy S1±2.

Example 9

Statical pressure sensitization and dynamical pressure desensitization were measured for silver chlorobromide and bromoiodide emulsion crystals:

statical pressure sensitization was qualitatively evaluated at the site where the coating number was punched, whereas dynamical pressure desensitization (quantitatively expressed as the density-difference at D=1.50+fog for the reference sample, between this reference sample and a sample of the same coating material, being subjected to a dynamic folding procedure to be described as folding the material over an axle and transporting it over this axle. The axle has a central part where no pressure fog interferes, serving as a reference part. Immediately after this procedure the material is exposed for 0.0001 s with a Xenon-flash type EG&G FX272)

From these experiments it was learned that the pressure sensitivity for silver chlorobromide emulsions is superior if compared with silver bromoiodide emulsions. For the material containing silver chlorobromide Emulsion A no significant pressure marks could be observed, whereas for the silver bromoiodide Emulsion I significant pressure marks were observed.

We claim:

1. Method of reproducing an electronically stored medical image on a hardcopy material, comprising a support and on only one side thereof a silver halide emulsion layer and a hydrophilic colloid layer, wherein said emulsion layer comprises red or infrared sensitized homogeneous cubic silver chloride, silver chloroiodide, silver chlorobromide and/or silver chlorobromoiodide crystals having not less than 70 mole % of chloride ions and not more than 1 mole % of iodide and an average crystal size of from 0.12 to 0.30 μm; wherein said crystals are coated in an amount, expressed as an equivalent amount of silver nitrate of from 2 to 6 g per sq.m., and wherein said material has a hardening degree corresponding with a water absorption of up to 3 g per gram of gelatin at the emulsion side, the water absorption being measured by following steps:

preserving dry film material for 15 minutes in a conditioning room at 20° C. and 30% RH, covering backing topcoat layer of the said dry film material with a water impermeable tape, weighing the said dry film material, immersing unexposed material in demineralized water of 24° C. for 10 minutes, sucking up excessive amount of water present on top of outermost layers and immediately determining weight of the wet film and calculating measured weight differences between wet and dry film and calculating the said differences per square meter of film and dividing it by coated amount of gelatin per sq.m.;

said method of reproducing being characterized by the steps of image-wise exposure of said material with an electronically adressed red or infrared laser followed by development processing in a developer free from hardening agents in less than 20 seconds in a total processing time from 30 to 50 seconds from dry to dry, wherein said developer contains a compound corresponding to formula (I), a precursor thereof, a derivative thereof and/or a metal salt thereof

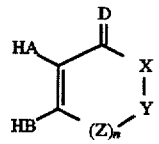

(I)

wherein each of A, B and D independently represents an oxygen atom or $NR^1$;

X represents an oxygen atom, a sulphur atom, $NR^2$; $CR^3R^4$; C=O; $C{=}NR^5$ or C=S;

Y represents an oxygen atom, a sulphur atom, $NR'^2$; $CR'^3R'^4$; C=O; $C{=}NR'^5$ or C=S;

Z represents an oxygen atom, a sulphur atom, $NR''^2$; $CR''^3R''^4$; C=O; $C{=}NR''^5$ or C=S;

n equals 0, 1 or 2;

each of $R^1$ to $R^5$, $R'^1$ to $R'^5$ and $R''^1$ to $R''^5$, independently represents hydrogen, alkyl, aralkyl, hydroxyalkyl, carboxyalkyl, alkenyl, alkynyl, cycloalkyl, cycloalkenyl, aryl or heterocyclyl;

and wherein $R^3$ and $R^4$, $R'^3$ and $R'^4$, $R''^3$ and $R''^4$, may further form together a ring; and wherein in the case that $X{=}CR^3R^4$ and $Y{=}CR'^3R'^4$, $R^3$ and $R'^3$ and/or $R^4$ and $R'^4$ may form a ring and wherein in the case that $Y=CR'^3R'^4$ and $Z=CR''^3R''^4$ with n=1 or 2, $R'^3$ and $R''^3$ and/or $R'^4$ and $R''^4$ may form a ring;

replenishing said developer in an amount of not more than 100 ml per square meter of developed material;

fixing said developer in a time from 2 to 10 seconds rinsing and drying.

2. Method according to claim 1, wherein in said hardcopy material said crystals have not less than 90 mole % of chloride ions.

3. Method according to claim 1, wherein in said hardcopy material said crystals have an average crystal size of from 0.15 to 0.25 μm.

4. Method according to claim 1, wherein in said hardcopy material said crystals are containing iridium(III) as a dopant in an amount from 0.5 to 20 μmole per mole of silver.

5. Method according to claim 1, wherein said crystals are chemically sensitized in the presence of at least one selenium compound.

6. Method according to claim 1, wherein said crystals are spectrally sensitized to the red or infrared wavelength region of the wavelength spectrum by means of a spectral sensitizer selected from the group consisting of di-, tri-, tetra-, penta- and heptamethine cyanines and merocyanines, rhodacyanines or polynuclear merocyanines.

7. Method according to claim 1, wherein the total gelatin content at the emulsion side is from 1 to 3 $g/m^2$.

8. Method according to claim 1, wherein a silver content at the emulsion side, expressed as an equivalent amount of silver nitrate, is from 3 to 5 $g/m^2$.

9. Method according to claim 1, wherein said hardcopy material is hardened with di-(vinyl-sulphonyl)-methane or ethylene di-(vinyl-sulphone).

10. Method according to claim 1, wherein during said development processing developing proceeds with a solution comprising thiocyanate ions in amounts between $10^{-3}$ and $10^{-1}$ molar and/or in amounts from 0.1 to 5 g per liter a compound corresponding to the formula (II), accompanied by charge compensating anions,

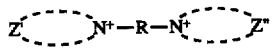

(II)

wherein at least divalent group R contains at least one oxyethylene group and wherein Z' and Z", being the same or different, are composed of enough atoms to form a heterocyclic aromatic 5- or 6-ring.

11. Method according to claim 1, wherein during said development processing developing proceeds with a solution comprising a hydroquinone and a compound corresponding to formula (I) in a ratio by weight of up to 9:1.

12. Method according to claim 1, wherein during said development processing developing proceeds with a solution comprising a hydroquinone and a compound corresponding to formula (I) in a ratio by weight of up to 1:1.

13. Method according to claim 1, wherein during said development processing replenishment amounts are from 25 to 75 $ml/m^2$ of developed material.

14. Method according to claim 1 comprising the steps of exposing said hardcopy material with a red or infrared laser source within a time of less than or equal to 10 s for a size format of 14"×17";

transporting said hardcopy material to an automatic processor within a time of up to 5 seconds;

processing dry-to-dry said hardcopy material in said automatic processor proceeding within a time of from 30 to 50 s making use of developer and fixer solutions free from hardening agents;

providing per minute at least 4 consecutive sheets with a size format of 17"×14".

* * * * *